US007794581B2

(12) United States Patent
Krüger et al.

(10) Patent No.: US 7,794,581 B2
(45) Date of Patent: Sep. 14, 2010

(54) PROCESS FOR THE SURFACE TREATMENT OF A COMPONENT, AND APPARATUS FOR THE SURFACE TREATMENT OF A COMPONENT

(75) Inventors: Ursus Krüger, Berlin (DE); Daniel Körtvelyessy, Berlin (DE); Ralph Reiche, Berlin (DE); Jan Steinbach, Berlin (DE); Gabriele Winkler, Berlin (DE)

(73) Assignee: Siemens Aktiengesellschaft, Munich (DE)

( * ) Notice: Subject to any disclaimer, the term of this patent is extended or adjusted under 35 U.S.C. 154(b) by 1316 days.

(21) Appl. No.: 11/170,662

(22) Filed: Jun. 29, 2005

(65) Prior Publication Data

US 2006/0084190 A1 Apr. 20, 2006

(30) Foreign Application Priority Data

Jun. 30, 2004 (EP) ..... 04015424

(51) Int. Cl.
*B23H 7/18* (2006.01)
*B23H 3/02* (2006.01)
*C25D 21/12* (2006.01)

(52) U.S. Cl. ..... 205/643; 205/83; 205/644; 204/228.1; 204/228.7

(58) Field of Classification Search ..... 205/644, 205/83, 643; 204/228.1, 228.7
See application file for complete search history.

(56) References Cited

U.S. PATENT DOCUMENTS

| | | | | |
|---|---|---|---|---|
| 4,539,087 | A | 9/1985 | Pojbics et al. | |
| 4,713,153 | A | 12/1987 | Adriaensen et al. | |
| 6,024,792 | A | 2/2000 | Kurz et al. | |
| 7,232,760 | B2 * | 6/2007 | Nogami et al. | 438/692 |
| 2003/0062271 | A1 | 4/2003 | Kool et al. | |
| 2003/0109198 | A1 * | 6/2003 | Lee et al. | 451/8 |
| 2004/0104128 | A1 * | 6/2004 | Sato et al. | 205/644 |
| 2004/0188273 | A1 * | 9/2004 | Nogami et al. | 205/644 |
| 2005/0098445 | A1 * | 5/2005 | Batzinger et al. | 205/644 |
| 2005/0167266 | A1 * | 8/2005 | Brusic et al. | 204/296 |
| 2006/0163074 | A1 * | 7/2006 | Manens et al. | 205/81 |

FOREIGN PATENT DOCUMENTS

| | | | |
|---|---|---|---|
| DE | 102 59 365 | A1 | 10/2003 |
| EP | 0 892 090 | A1 | 1/1999 |
| EP | 1 094 134 | A1 | 4/2001 |
| EP | 1 204 776 | B1 | 5/2002 |
| EP | 1 306 454 | A1 | 5/2003 |
| EP | 1 319 729 | A1 | 6/2003 |
| EP | 1 473 387 | A1 | 11/2004 |
| WO | WO 99/67435 | | 12/1999 |
| WO | WO 00/44949 | | 8/2000 |
| WO | 03085174 | A2 | 10/2003 |

* cited by examiner

*Primary Examiner*—Alexa D. Neckel
*Assistant Examiner*—Nicholas A. Smith

(57) ABSTRACT

Components which are subject to operating loads can often be passed for refurbishment by means of an acid treatment. The time for which the components remain in the acid has hitherto been determined empirically, which means that individual loads are not taken into account. The process according to the invention for the surface treatment of a component proposes that at least repeatedly a measurement voltage be applied to the component, resulting in the flow of a current, the time profile of which represents the state of the surface treatment and is used to decide upon when to terminate or interrupt the acid treatment.

23 Claims, 6 Drawing Sheets

PROCESS FOR THE SURFACE TREATMENT OF A COMPONENT, AND APPARATUS FOR THE SURFACE TREATMENT OF A COMPONENT

CROSS REFERENCE TO RELATED APPLICATION

This application claims priority of the European application No. 04015424.7 EP filed Jun. 30, 2004, which is incorporated by reference herein in its entirety.

FIELD OF THE INVENTION

The invention relates to a process for the surface treatment of a component in accordance with the preamble of claim 1 and to an apparatus for carrying out a process for the surface treatment of a component.

BACKGROUND OF THE INVENTION

Components which are subject to operating loads, such as for example turbine blades and vanes of gas turbines, are subjected to an electrolyte treatment, so that the component can then be refurbished. In the case of gas turbine blades and vanes, the MCrAlX layers on the component, which are subject to operating loads, are removed by being immersed in 20% strength hydrochloric acid at approx. 50°-80° C. After a period of time derived from values gained through experience, the blades or vanes are removed from the acid bath, rinsed with water and then abrasively blasted. The process sequence of electrolyte bath followed by blasting is repeated a number of times until the entire MCrAlX layer has been removed or dissolved. The repetition of the individual process steps is generally necessary, since the electrolyte only dissolves aluminum-containing phases of the MCrAlX layer close to the surface. Deeper-lying regions of the MCrAlX layer therefore cannot be dissolved in one step. A porous layer matrix remains on the surface and is subsequently removed by blasting, for example mechanically.

The time for which the blades or varies remain in the electrolyte does not in this case reflect the time which is actually required for the individual blade or vane to conclude the dissolution process, but rather is set as standard to a specific time. The residence time in the electrolyte is in this case determined on the basis of general empirical values.

However, each individual component is subject to different levels of load, which means that a fixed preset time leads to different or incomplete dissolution of the surface of the component which is subject to load. In many cases, the components remain in the acid bath until the predetermined period of time has elapsed without any further progress being made in the removal of the coating.

EP 1 094 134 A1 and US 2003/0062271 A1 disclose processes for the electrochemical removal of layers.

U.S. Pat. No. 4,539,087 discloses a method in which the current of an electrolytic process is measured, so that on the basis of the current profile it is possible to reach a decision as to when to terminate the process.

SUMMARY OF THE INVENTION

Therefore, it is an object of the invention to provide a process which allows the minimum treatment time required for each individual component (type, coating thickness, state after operating load, etc.) to be determined individually.

The object is achieved by a process for the surface treatment of a component as claimed in the claims.

A further object of the invention is to provide an apparatus which allows the minimum treatment times required to be determined individually for each individual component.

This object is achieved by an apparatus for the surface treatment of a component as claimed in claim 27.

Further advantageous measures, which can be advantageously combined with one another in any desired way, are listed in the subclaims.

DETAILED DESCRIPTION OF THE INVENTION

Figure 1:
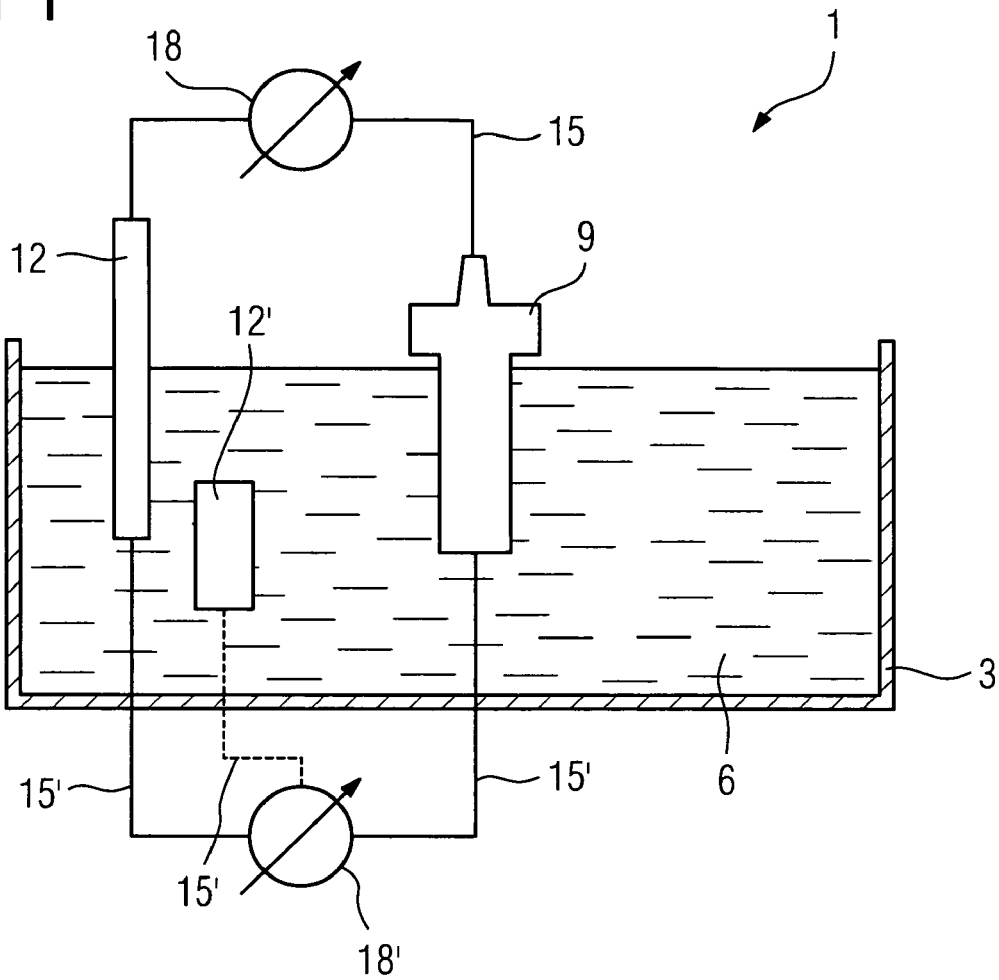
FIG. 1 shows an apparatus for carrying out the process according to the invention.

FIG. 1 shows an example of an apparatus 1 according to the invention which can be used to carry out the process according to the invention.

The apparatus 1 comprises a vessel 3, for example metallic, ceramic or made from plastic (Teflon polymer, etc.), in which there is a treatment agent 6, for example an acid 6 or an electrolyte 6 (comprising coating material), which is used for the surface treatment of, such as the removal of a coating from or application of a coating to, at least one component 9.

In the case of the removal of a coating, it is preferable for an acid or an acid mixture to be present in the vessel 3.

By contrast, in the case of the application of a coating, the electrolyte 6 includes the corresponding chemical elements for the coating. In this case, by way of example, a single component 9, the surface region of which is to be dissolved, is arranged in the treatment agent 6. This dissolution is effected, for example, by the acid attack on, for example, the surface of the component 9 which is subject to operating loads.

If the coating is to be removed from two or more components 9, by way of example the two components 9 in each case form an electrode (i.e. anode and cathode), and in this case the treatment agent 6 used should be a nitrogen-containing treatment agent 6.

According to the invention, there is at least one voltage/current source 18, which is electrically connected to the component 9 and a further electrode 12 via electrical connection means 15. A first circuit can be closed by the connection means 15 being connected to a further electrical pole, i.e. the electrode 12, which is arranged in the treatment agent 6 or connected to the vessel 3, so that a current I can flow between component 9 and the pole 3, 12 and can also be measured. The current flows across the component 9 via the surface of the component 9 which is subjected to load and then flows through the treatment agent 6 to the electrode 12 (or to the vessel 3).

It is also possible for a plurality of components 9 to be arranged in a vessel 3 in order for their coating to be removed, in which case a current curve I(t) can be determined individually for each component 9, so that the components 9 if appropriate remain in the treatment agent 6 for different lengths of time.

A further second circuit comprising lines 15' and current/voltage source 18', for example for a measurement voltage 33 (FIG. 2), may also be present in accordance with the invention, so that a current likewise flows through this circuit and can also be measured.

The lines 15' are then likewise connected to the component 9 and the electrode 12.

Figure 2:
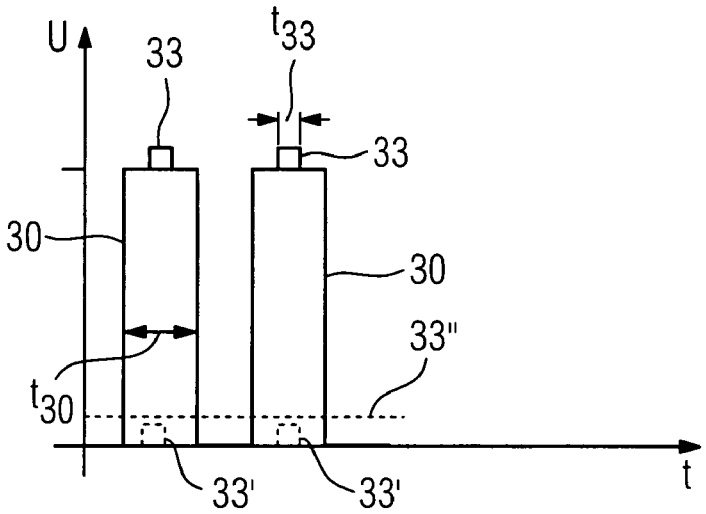
FIGS. 2, 3, 4 show a time/voltage profile.

FIG. 2 shows an example of a voltage profile according to the invention.

Figure 7:
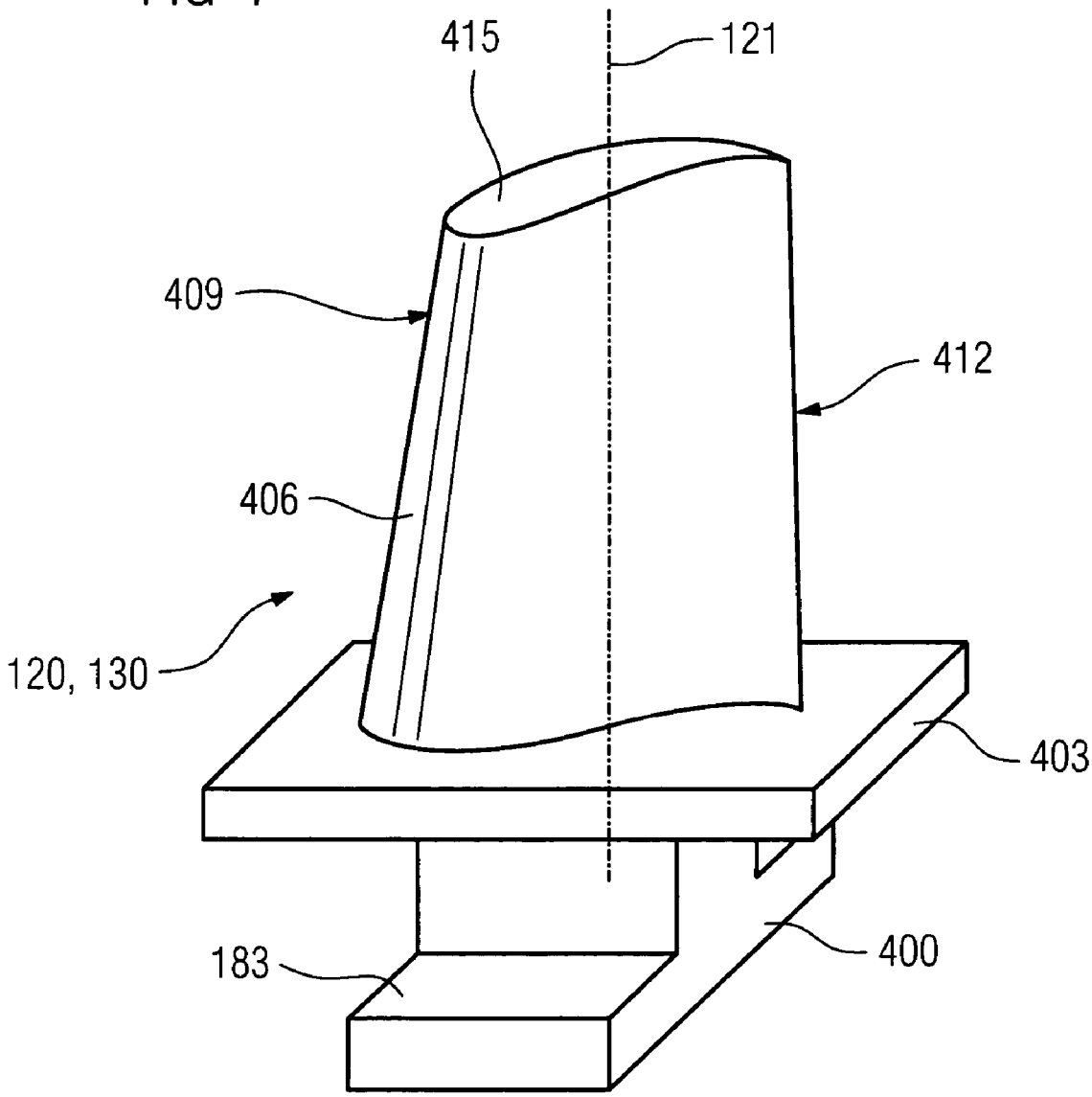
FIG. 7 shows a turbine blade or vane.
Figure 9:
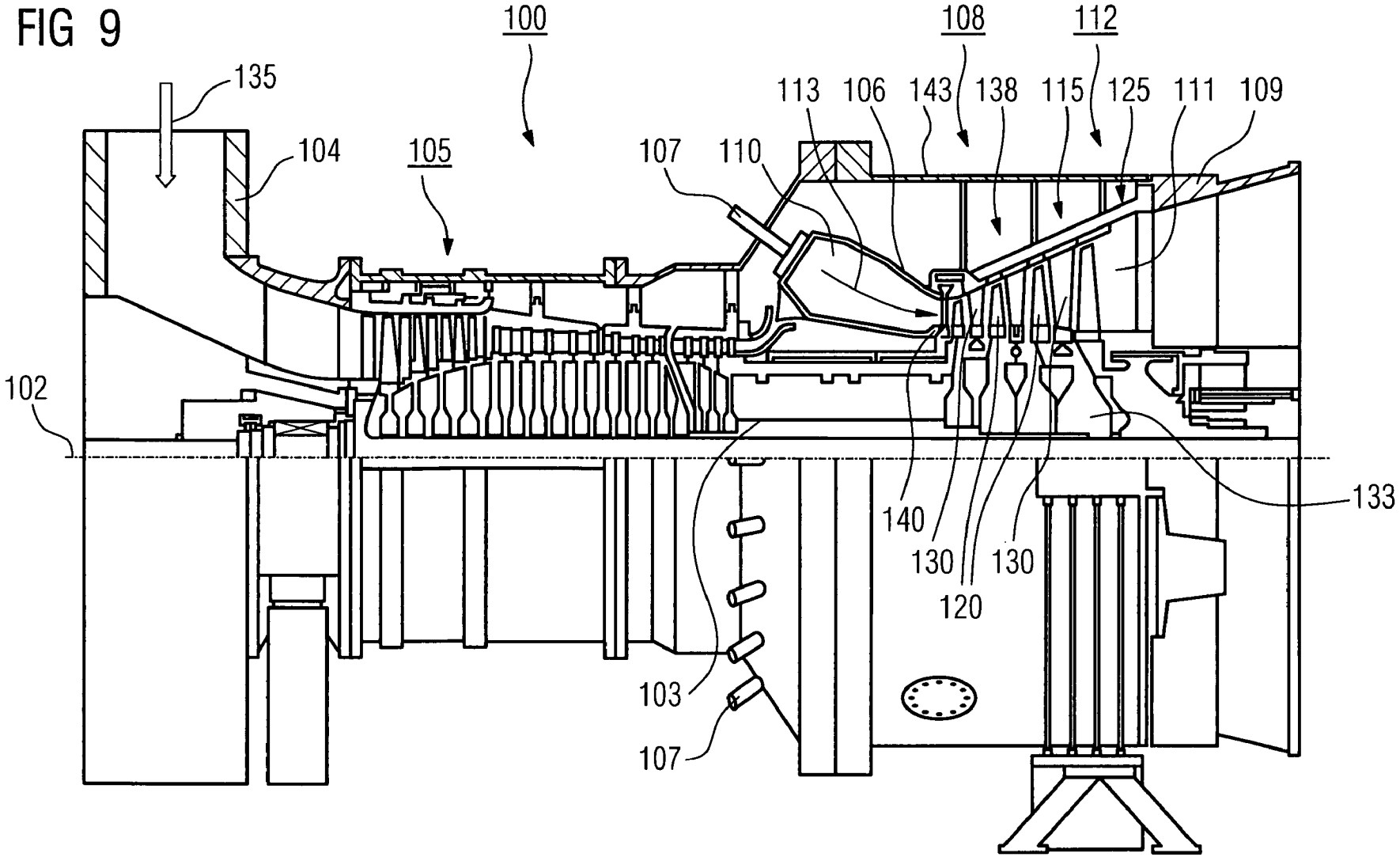
FIG. 9 shows a gas turbine.

To remove the coating from a large component 9, a pulsed treatment voltage 30 with a pulse duration $t_{30}$ is applied, generating currents of up to 100 A, for example, for correspondingly large components 9 (length 38 cm), such as gas turbine blades or vanes 120, 130 (FIGS. 7, 9).

The pulse duration $t_{30}$ may always be the same or may change with time t. The magnitude of the treatment voltage may also change with time t.

However, these currents are too high for it to be possible to obtain more accurate information about the progress of the surface treatment from the transient properties of the current profile (cooling times are too long, for example).

Therefore, according to the invention, a lower, for example pulsed, measurement voltage 33 (1 mV to 50 mV) is superimposed on the higher treatment voltage 30 (for removal of the coating) in the circuit (18, 15, 9, 6, 12), or the treatment voltage 30 is briefly (i.e. at least at times) increased by the magnitude of the measurement voltage 33.

The pulse duration $t_{33}$ of the measurement voltage 33 may be shorter than, equal to or longer than the pulse duration $t_{30}$ of the treatment voltage 30.

If the pulse duration $t_{33}$ of the measurement voltage 33 is shorter than the pulse duration $t_{30}$ of the treatment voltage 30, the measurement voltage 33 may be applied at the start, in the middle or at the end of the pulsed treatment voltage 33.

The lower measurement voltage 33 generates very much lower currents, which can be measured more successfully.

The signals relating to the treatment voltage 30 and the measurement voltage 33 are separated, for example, by analysis of the current curve by means of mathematical signal separation methods, such as for example Fourier analysis.

By way of example, it is possible to use three electrodes corresponding to the treatment voltage 30 for the removal of the coating and to the measurement voltage 33 (a further electrode 12' for a second circuit (FIG. 1) with lines 15' and current/voltage source 18' for a measurement voltage 33 may also be present in accordance with the invention; in this case, the lines 15' are likewise connected to the component 9 and, for example, to the electrode 12' (indicated by dashed lines) and not to the electrode 12), in which case the voltages are superimposed on the large surface. The separation of the current signals by measurement means is effected, for example, by the use of two partially decoupled circuits (15+18+9+6+12; 15'+18'+9+6+12 or +12').

The contribution of the lower measurement voltage 33 to the electrolytic removal of the coating is low or negligible.

When using a pulsed treatment voltage 30, it is likewise possible to use a DC measurement voltage 33" (indicated by dashed lines).

Figure 3:
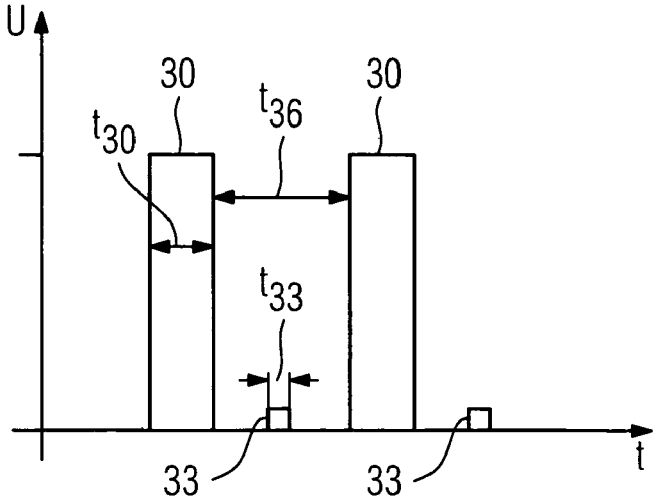

FIG. 3 shows a further example of a voltage profile according to the invention for the method according to the invention.

Here, once again a high pulsed treatment voltage 30, which generates very high currents, is used to remove the coating.

The measurement voltage 33 is in this case, for example, likewise pulsed and is applied during the interpulse periods 36 ($t_{36}$) of the treatment voltage pulses 30 ($t_{36}>t_{33}$). This is done by synchronizing the voltage pulses 30, 33.

Figure 4:
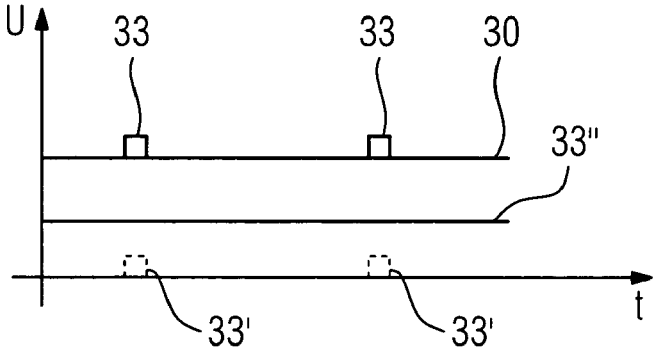

FIG. 4 shows examples of further voltage profiles.

In this case, a treatment voltage 30 of a constant level (DC voltage) is applied to the component 9 for electrolytic coating removal, while the measurement voltage 33 is once again pulsed and superimposed on the treatment voltage 30.

In this case, the treatment voltage 30 can be briefly increased (corresponding to a pulsed increase) by the magnitude of the measurement voltage 33, in which case only one circuit is required, or alternatively the measurement voltage 33' (indicated by dashed lines) is superimposed on the treatment voltage, for example by a second circuit.

It is likewise possible to use a lower DC measurement voltage 33", in particular in a second circuit 18', 15', 9, 6, 12 or 12'.

The pulse durations $t_{33}$, $t_{30}$ may be identical or different ($t_{30}=t_{33}$, $t_{33}<t_{30}$, $t_{33}>t_{30}$, $t_{30}=t_{33}$ and $t_{36}>t_{30}$, etc.).

Figure 5:
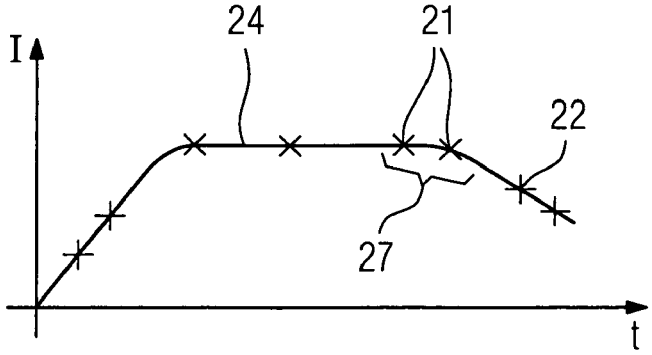
FIGS. 5, 6 show time profiles for voltages and current which result when carrying out the process according to the invention.

A time profile of the current I(t) caused by the measurement voltage during electrolysis for coating removal is illustrated in FIG. 5.

The current I(t) initially rises with time t and after a certain point in time is initially substantially constant. The coating removal is not yet complete, i.e. the coating removal rate is still high.

After a certain time t, the current I drops. The drop (range or point 27 in curve I(t)) in the current I indicates that only a small amount of coating material is being dissolved. Consequently, the dissolution process can be stopped when, for example, a predetermined comparison value for the current intensity has been reached or the current intensity drops by a certain amount (cf. difference between measurement points 27, 22) or when a trend line indicates a falling profile for the current intensity.

This applies analogously to the coating processes when the electrolyte 6 has been consumed or the coating thickness is determined from the surface area below the curve I(t).

The process can also be carried out in substeps. In this case, in a process intermediate step an abrasive coating removal is in each case carried out, removing residues of acid products and/or accelerating the coating removal, since after a certain residence time of the component 9 in the treatment agent 6, by way of example, a brittle layer forms, which can be removed more successfully by abrasive means.

It is also possible for the component 9 to be washed (rinsed) in a process intermediate step.

Then, the component 9 is once again positioned in the treatment agent 6.

The process steps of treatment of the component 9 in the treatment agent 6 and abrasive blasting can be repeated as desired.

The removal of the coating from the component(s) 9 proceeds even without the presence of a treatment voltage, i.e. the coating removal process is not at that time electrolytic.

Figure 6:
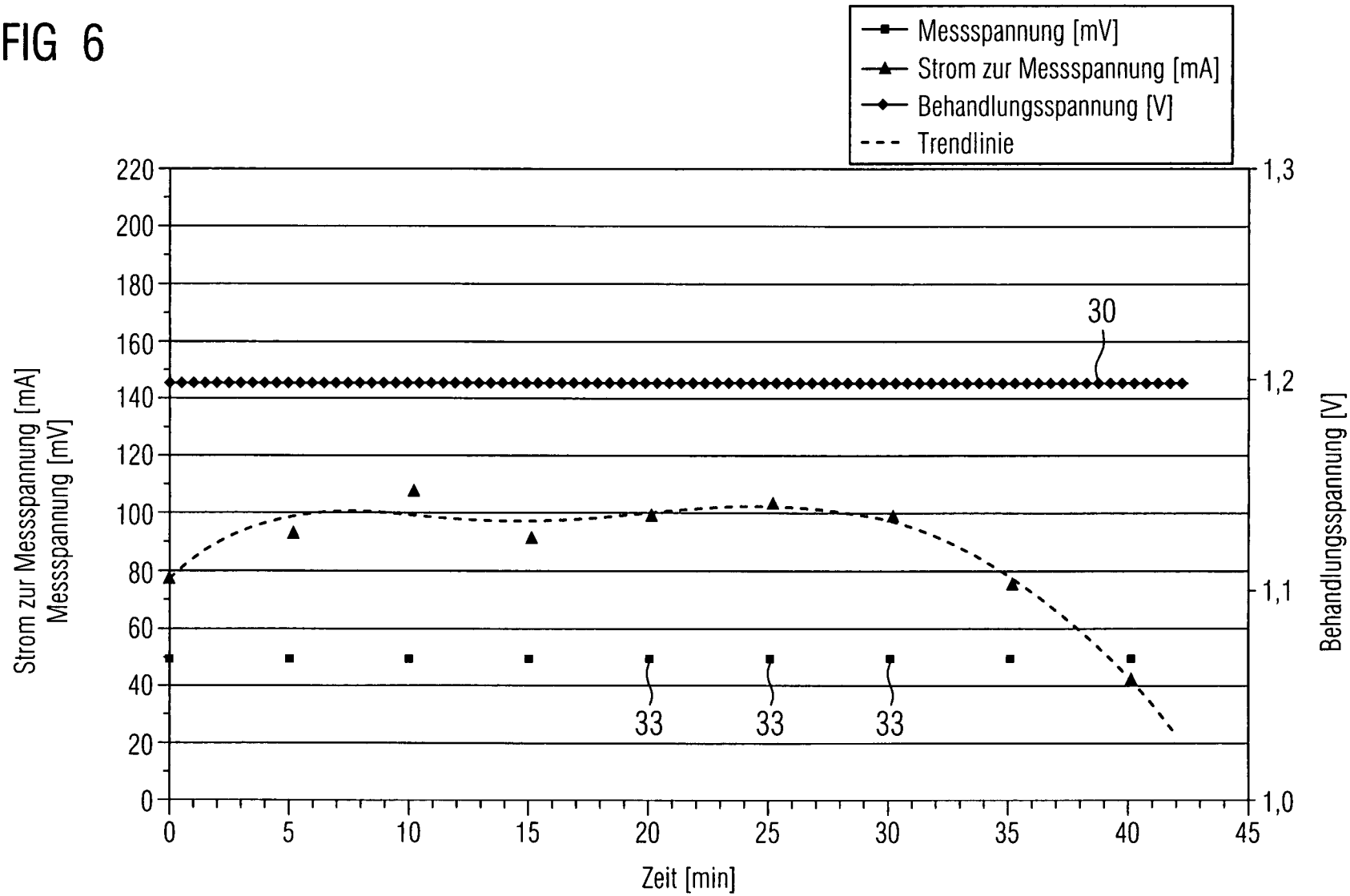

FIG. 6 shows an experimentally determined profile for the currents and voltages measured or used.

A constant treatment voltage 30 of 1.2 V is applied to a turbine blade or vane (length≈18 cm, surface area≈150 $cm^2$); the electrolyte used is, for example, 5% HCl (hydrochloric acid) containing 2% triethanolamine. The treatment voltage 30 is represented by the diamond shapes and generates a current I of 10 to 11 A (not shown).

The pulsed measurement voltage 33 for determining the end point is in this case, for example, 50 mV and is applied by pulses with a pulse length of, for example, 0.5 s. The ratio of the measurement voltage 33 to the treatment voltage 30 is therefore 1:24; alternatively it may, for example, be 1:10 (or 1:20, 1:30 or greater than 1:50, 1:100).

The measurement voltage 33 is represented by squares in FIG. 6. The current I, which is measured as a result of the measurement voltage 33, is represented by the triangles in FIG. 6. A separating line (indicated in dashed lines) shows the intrapolated and expected time profile of the current. This curve corresponds to that shown in FIG. 2.

The time profile 24 of the current I(t) can also be determined from individual measurement points 21 which are taken at regular or irregular intervals.

The components from which the coating is removed in the following descriptions of figures can be coated again, as explained in the following descriptions of figures.

FIG. 7 shows a perspective view of a blade or vane 120, 130 which extends along a longitudinal axis 121.

The blade or vane as an example of the component 9 may be a rotor blade 120 or a guide vane 130 of a turbomachine. The turbomachine may be a gas turbine of an aircraft or a power plant for generation of electricity, a steam turbine or a compressor.

The blade or vane 120, 130 includes, in succession along the longitudinal axis 121, a securing region 400, an adjoining blade or vane platform 403 and a main blade or vane part 406. When used as a guide vane 130, the vane may have a further platform (not shown) at its vane tip 415.

In the securing region 400 there is a blade or vane root 183, which is used to secure the rotor blades 120, 130 to a shaft or a disk (not shown).

The blade or vane root 183 is designed, for example, in the shape of a hammerhead. Other configurations, such as a fir-tree root or a dovetail root, are also possible.

The blade or vane 120, 130 has a leading edge 409 and a trailing edge 412 with respect to a medium which flows past the main blade or vane part 406.

With conventional blades or vanes 120, 130, by way of example, solid metal materials are used in all regions 400, 403, 406 of the blade or vane 120, 130.

The blade or vane 120, 130 can in this case be produced by a casting process, or also by means of directional solidification, by means of a forging process, by means of a milling process or by combinations thereof.

Workpieces with a single-crystal structure or structures are used as components for machines which are exposed to high mechanical, thermal and/or chemical loads in operation.

Single-crystal workpieces of this type are produced, for example, by directional solidification from the melt. This involves casting processes in which the liquid metal alloy solidifies to form a single-crystal structure, i.e. a single-crystal workpiece, or solidifies directionally.

In this case, dendritic crystals are oriented along the heat flow direction and form either a columnar grain structure (i.e. grains which extend over the entire length of the workpiece and are in this case referred to as directionally solidified, in accordance with the standard terminology employed in the field) or a single-crystal structure, i.e. the entire workpiece comprises a single crystal. In these processes, the transition to globulitic (polycrystalline) solidification has to be avoided, since non-directional growth inevitably results in the formation of transverse and longitudinal grain boundaries which negate the good properties of the directionally solidified or single-crystal component.

Wherever the text speaks in general terms of directionally solidified microstructures, this is to be understood as meaning both single crystals, which do not have any grain boundaries or at most have small-angled grain boundaries, and columnar crystal structures, which do have grain boundaries running in the longitudinal direction but do not have any transverse grain boundaries. The latter crystalline structures are also known as directionally solidified structures.

Processes of this type are known from U.S. Pat. No. 6,024,792 and EP 0 892 090 A1.

Refurbishment means that protective layers may have to be removed (e.g. by sandblasting) from components 120, 130 after they have been used, by the process according to the invention. This is followed by removal of the corrosion and/or oxidation layers or products. If appropriate, cracks in the component 120, 130 are also repaired. This is followed by further coating of the component 120, 130, for example by the process according to the invention, and renewed use of the component 120, 130.

The blade or vane 120, 130 may be of hollow or solid design. If the blade or vane 120, 130 is to be cooled, it is hollow and may also include film-cooling holes (not shown). To protect against corrosion, the blade or vane 120, 130 by way of example has corresponding, generally metallic coatings, and, to protect against heat, generally also a ceramic coating.

Figure 8:
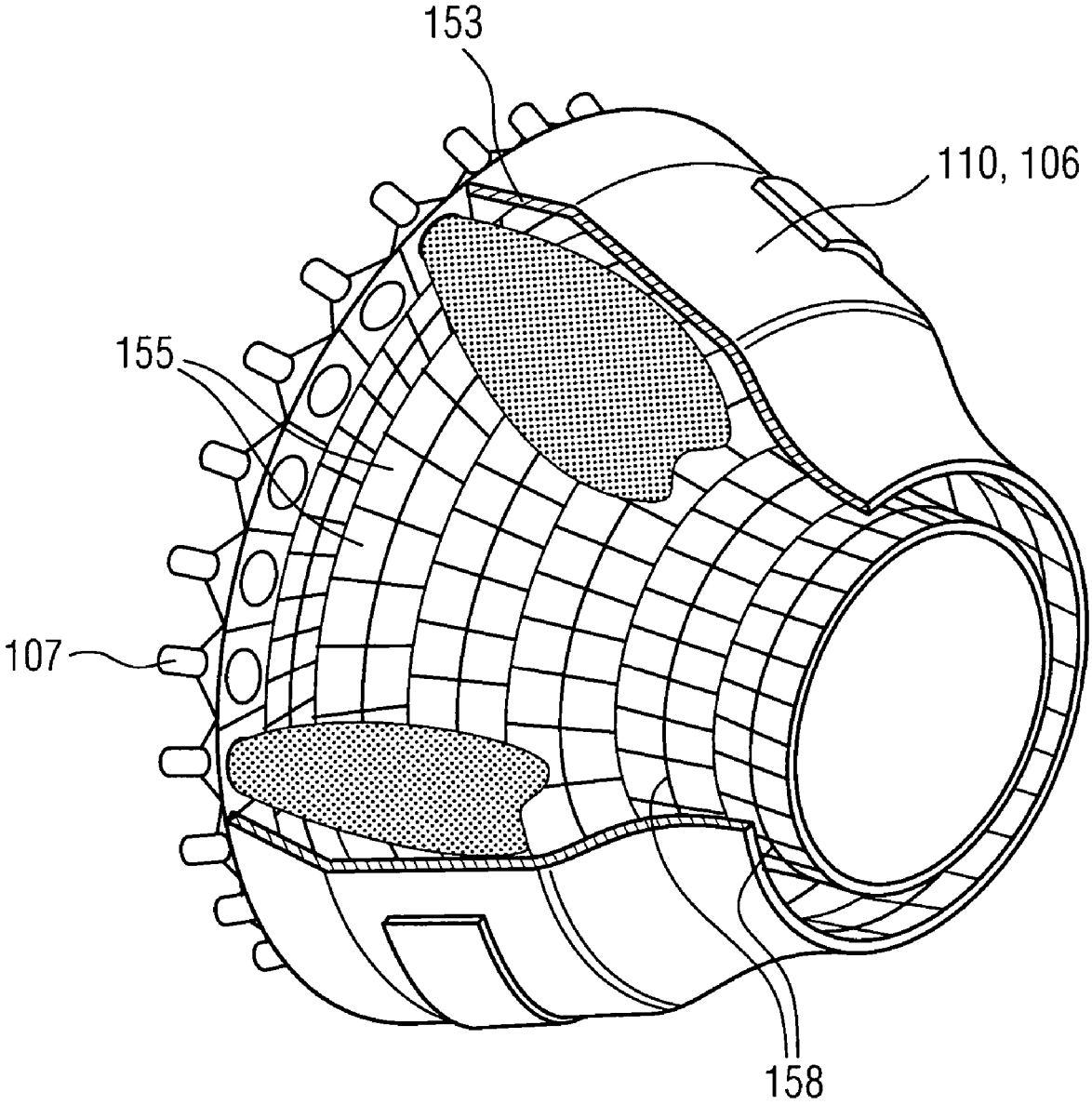
FIG. 8 shows a combustion chamber.

FIG. 8 shows a combustion chamber 110 of a gas turbine. The combustion chamber 110 is configured, for example, as what is known as an annular combustion chamber, in which a large number of burners 102 arranged circumferentially around the turbine shaft 103 open out in a common combustion-chamber space. For this purpose, the combustion chamber 110 overall is configured as an annular structure positioned around the turbine shaft 103.

To achieve a relatively high efficiency, the combustion chamber 110 is designed for a relatively high temperature of the working medium M of approximately 1000° C. to 1600° C. To allow a relatively long operating time even under these operating parameters, which are unfavorable for the materials, the combustion chamber wall 153 is provided, on its side facing the working medium M, with an inner lining formed from heat shield elements 155 (a further example of component 9). On the working medium side, each heat shield element 155 is equipped with a particularly heat-resistant protective layer or is made from material which is able to withstand high temperatures. Moreover, on account of the high temperatures in the interior of the combustion chamber 110, a cooling system is provided for the heat shield elements 155 or for the holding elements thereof.

The materials of the combustion chamber wall and their coatings may be similar to the turbine blades or vanes.

FIG. 9 shows, by way of example, a gas turbine 100 in the form of a longitudinal part-section.

In the interior, the gas turbine 100 has a rotor 103 which is mounted such that it can rotate about an axis of rotation 102 and is also referred to as the turbine rotor.

An intake casing 104, a compressor 105, a, for example, toroidal combustion chamber 110, in particular an annular combustion chamber 106, with a plurality of coaxially arranged burners 107, a turbine 108 and the exhaust-gas casing 109 follow one another along the rotor 103.

The annular combustion chamber 106 is in communication with a, for example, annular hot-gas duct 111, where, for example, four turbine stages 112 in succession form the turbine 108.

Each turbine stage 112 is formed, for example, from two blade/vane rings. As seen in the direction of flow of a working medium 113 in the hot-gas duct 111, a row of guide vanes 115 is followed by a row 125 of rotor blades 120.

The guide vanes 130 are secured to an inner casing 138 of a stator 143, whereas the rotor blades 120 belonging to a row 125 are, for example, fitted to the rotor 103 by means of a turbine disk 133.

A generator or machine (not shown) is coupled to the rotor 103.

While the gas turbine 100 is operating, the compressor 105 sucks in air 135 through the intake casing 104 and compresses it. The compressed air provided at the turbine-side end of the compressor 105 is passed to the burners 107, where it is mixed with a fuel. The mixture is then burnt so as to form the working medium 113 in the combustion chamber 110. From there, the working medium 113 flows along the hot-gas duct 111 past the guide vanes 130 and the rotor blades 120. At the rotor blades 120, the working medium 113 expands, transferring its momentum, so that the rotor blades 120 drive the rotor 103 and the latter in turn drives the machine coupled to it.

The components exposed to the hot working medium 113 are subject to thermal loads when the gas turbine 100 is operating. The guide vanes 130 and rotor blades 120 of the first turbine stage 112, as seen in the direction of flow of the working medium 113, together with the heat shield bricks lining the annular combustion chamber 106, are subject to the highest thermal loads.

To be able to withstand the prevailing temperatures, these components can be cooled by means of a coolant.

It is likewise possible for substrates of the components to have a directional structure, i.e. for them to be in single-crystal form (SX structure) or to have only longitudinally directed grains (DS structure).

By way of example, iron-base, nickel-base or cobalt-base superalloys are used as material for the components, in particular for the turbine blade or vane 120, 130 and components of the combustion chamber 110.

Superalloys of this type are known, for example, from EP 1204776, EP 1306454, EP 1319729, WO 99/67435 or WO 00/44949; these documents likewise form part of the present disclosure.

It is also possible for the blades or vanes 120, 130 to have coatings to protect against corrosion (MCrAlX; M is at least one element selected from the group consisting of iron (Fe), cobalt (Co), nickel (Ni), X is an active element and stands for yttrium (Y) and/or silicon and/or at least one rare earth) and against heat (thermal barrier coating).

The thermal barrier coating consists, for example, of $ZrO_2$, $Y_2O_4$—$ZrO_2$, i.e. it is not stabilized, or is partially or completely stabilized by yttrium oxide and/or calcium oxide and/or magnesium oxide.

Columnar grains are produced in the thermal barrier coating by suitable coating processes, such as for example electron beam physical vapor deposition (EB-PVD).

The guide vane 130 has a guide vane root (not shown here) facing the inner casing 138 of the turbine 108, and a guide vane head at the opposite end from the guide vane root. The guide vane head faces the rotor 103 and is fixed to a securing ring 140 of the stator 143.

The invention claimed is:

1. A process for a surface treatment of a component, comprising:

arranging the component in a treatment agent;

applying a treatment voltage to the component and a pole, wherein the pole is spaced apart from the component, and wherein the component is a first electrode of a treatment circuit; and applying a measurement voltage to the component and the pole, wherein the component is a first electrode of a measurement circuit, so that as a result a time-dependent current flows and has a time profile that represents a state of the surface treatment and is used to reach a decision on when to terminate or interrupt the surface treatment.

2. The process as claimed in claim 1, wherein the treatment voltage used is a DC voltage.

3. The process as claimed in claim 1, wherein the treatment voltage is pulsed.

4. The process as claimed in claim 1, wherein the measurement voltage used is a DC voltage.

5. The process as claimed in claim 1, wherein the measurement voltage is pulsed.

6. The process as claimed in claim 5, wherein the pulsed measurement voltage is applied together with the pulsed treatment voltage and the pulse measurement voltage is applied between pulsed treatment voltages.

7. The process as claimed in claim 5, wherein a pulse duration of the measurement voltage is shorter than the pulse duration of the treatment voltage.

8. The process as claimed in claim 1, wherein the measurement voltage has a ratio of at least 1:10 with respect to the treatment voltage.

9. The process as claimed in claim 1, wherein the component comprises a coating to be removed, and the surface treatment is used to remove the coating from the component.

10. The process as claimed in claim 1, wherein the surface treatment is used to coat the component.

11. The process as claimed in claim 1, wherein the pole is a second electrode disposed in the treatment agent.

12. The process as claimed in claim 11, wherein the second electrode disposed in the treatment agent is another component.

13. The process as claimed in claim 1, wherein the treatment agent used is an acid.

14. The process as claimed in claim 1, wherein the current initially rises with time and then remains relatively constant.

15. The process as claimed in claim 1, wherein a drop in the current over the course of time identifies an end point of the removal of the coating.

16. The process as claimed in claim 1, wherein the surface treatment is carried out in sub-steps, with abrasive coating removal taking place in an intermediate step, and the component being again treated in the treatment agent.

17. The process as claimed in claim 16, wherein the one component is rinsed in the intermediate step.

18. The process as claimed in claim 1, wherein a single component is treated.

19. The process as claimed in claim 1, wherein a plurality of components are treated and for each component an individual time profile is determined.

20. The process as claimed in claim 1, wherein a common circuit is used for the treatment voltage and the measurement voltage.

21. A process for a surface treatment of a component, comprising:

arranging the component in a treatment agent;

applying a treatment voltage to the component and pole spaced apart from the component, wherein the component is a first electrode of a treatment circuit, and the treatment voltage is a DC voltage; and applying a measurement voltage to the component and the pole, wherein the component is a first electrode of a measurement circuit, wherein the measurement voltage has a ratio of at least 1:10 with respect to the treatment voltage, and wherein as a result a time-dependent current flows and has a time profile that represents a state of the surface treatment and is used to reach a decision on when to terminate or interrupt the surface treatment.

22. The process as claimed in claim 21, wherein the treatment voltage is pulsed.

23. The process as claimed in claim 21, wherein the measurement voltage is a DC voltage or pulsed.

* * * * *